US010907419B2

(12) United States Patent
Reeves et al.

(10) Patent No.: US 10,907,419 B2
(45) Date of Patent: Feb. 2, 2021

(54) PINNED COUPLING WITH SHIMS FOR ELECTRIC SUBMERSIBLE PUMP

(71) Applicant: GE Oil & Gas Esp, Inc., Oklahoma City, OK (US)

(72) Inventors: Brian Paul Reeves, Edmond, OK (US); Chengbao Wang, Oklahoma City, OK (US); Steven Alan Howell, Oklahoma City, OK (US)

(73) Assignee: Baker Hughes ESP, Inc., Houston, TX (US)

( * ) Notice: Subject to any disclaimer, the term of this patent is extended or adjusted under 35 U.S.C. 154(b) by 196 days.

(21) Appl. No.: 15/522,911

(22) PCT Filed: Oct. 30, 2014

(86) PCT No.: PCT/US2014/063251
§ 371 (c)(1),
(2) Date: Apr. 28, 2017

(87) PCT Pub. No.: WO2016/068959
PCT Pub. Date: May 6, 2016

(65) Prior Publication Data

US 2017/0321493 A1 Nov. 9, 2017

(51) Int. Cl.

| | |
|---|---|
| ***E21B 17/02*** | (2006.01) |
| ***E21B 43/12*** | (2006.01) |
| ***F04D 13/10*** | (2006.01) |
| ***F04D 29/044*** | (2006.01) |

(52) U.S. Cl.
CPC ..... *E21B 17/02* (2013.01); *E21B 43/128* (2013.01); *F04D 13/10* (2013.01)

(58) Field of Classification Search
CPC ..... E21B 17/02; E21B 43/128; F04D 13/10; F04D 29/044
See application file for complete search history.

(56) References Cited

U.S. PATENT DOCUMENTS 5,688,067 A * 11/1997 Straub ..... E21B 43/121 403/300
7,775,779 B2 * 8/2010 Sheth ..... F04D 13/022 403/300
2003/0132003 A1 7/2003 Arauz et al.
(Continued)

OTHER PUBLICATIONS

Office Action issued in connection with corresponding CO Application No. NC2017/0005373 dated Sep. 20, 2018.
(Continued)

*Primary Examiner* — Matthew R Buck
(74) *Attorney, Agent, or Firm* — Baker Hughes Patent Organization

(57) ABSTRACT

A shaft coupling is useful for connecting a distal end of a first shaft with a proximal end of a second shaft. The shaft coupling includes a body, a first receiving chamber within the body and a second receiving chamber within the body. The first receiving chamber receives the distal portion of the first shaft and the second receiving chamber receives the proximal portion of the second shaft. A pin maintains the axial positioning between the body and the distal portion of the first shaft. An axially adjustable connection is used between the second receiving chamber and the proximal portion of the second shaft.

10 Claims, 3 Drawing Sheets

(56) References Cited

U.S. PATENT DOCUMENTS

| | | | | |
|---|---|---|---|---|
| 2005/0199384 | A1* | 9/2005 | Mack | F04D 13/021 166/105 |
| 2011/0171047 | A1* | 7/2011 | Parmeter | F04B 47/02 417/321 |
| 2014/0169988 | A1 | 6/2014 | Pesek et al. | |
| 2014/0209323 | A1* | 7/2014 | Pisetskiy | E21B 43/128 166/380 |
| 2014/0262259 | A1 | 9/2014 | Fouillard et al. | |

OTHER PUBLICATIONS

International Search Report and Written Opinion issued in connection with corresponding PCT Application No. PCT/US2014/063251, dated Jul. 15, 2015.

International Preliminary Report on Patentability issued in connection with corresponding PCT Application No. PCT/US2014/063251 dated May 2, 2017.

* cited by examiner

PINNED COUPLING WITH SHIMS FOR ELECTRIC SUBMERSIBLE PUMP

FIELD OF THE INVENTION

This invention relates generally to the field of submersible pumping systems, and more particularly, but not by way of limitation, to a mechanism for coupling shafts within a submersible pumping system.

BACKGROUND

Submersible pumping systems are often deployed into wells to recover petroleum fluids from subterranean reservoirs. Typically, the submersible pumping system includes a number of components, including one or more fluid filled electric motors coupled to one or more high performance pumps located above the motor. The pumps often include a number of turbomachinery stages that each includes a stationary diffuser and a rotatable impeller keyed to a shaft. When energized, the motor provides torque to the pump through the shaft to rotate the impellers, which impart kinetic energy to the fluid.

In many applications, the pump is positioned above the motor and is configured to drive fluid upward out of the well. The operation of the pump in this manner creates thrust in a downward direction that places a compressive force on the shaft. The thrust is conveyed along the drive shafts from the pump to a thrust chamber positioned between the pump and the motor. The thrust chamber protects the motor from the down thrust created by the pump.

In other applications, the location or operation of the pump may create a resultant thrust in a direction away from the thrust chamber. In these applications, the shafts extending from the motor to the pump are placed in tension rather than compression. The thrust chamber and shaft couplings must be designed to accommodate the tension imparted to the shafts in these applications.

SUMMARY OF THE INVENTION

In preferred embodiments, a shaft coupling is configured to connect a distal end of a first shaft with a proximal end of a second shaft. The shaft coupling includes a body, a first receiving chamber within the body and a second receiving chamber within the body. The first receiving chamber receives the distal portion of the first shaft and the second receiving chamber receives the proximal portion of the second shaft. A pin maintains the axial positioning between the body and the distal portion of the first shaft. An axially adjustable connection is used between the second receiving chamber and the proximal portion of the second shaft.

In another aspect, the preferred embodiments include a shaft coupling for connecting a distal end of a first shaft with a proximal end of a second shaft that includes an axially-directed center bore extending from the proximal end. The coupling includes a body, a first receiving chamber within the body and a second receiving chamber within the body. The first receiving chamber receives the distal portion of the first shaft and the second receiving chamber receives the proximal portion of the second shaft. The coupling includes a lock pin that extends through the body and through the distal end of the first shaft and an axial shaft bolt captured within the body of the coupling that is threadingly engaged to the center bore of the second shaft.

In yet another aspect, the preferred embodiments include an electric submersible pumping system that includes a motor, a pump below the motor, wherein the pump includes a pump shaft and wherein the pump is configured to discharge fluid upward toward the motor; and a seal section connected between the pump and the motor, wherein the seal section includes a seal section shaft. A shaft coupling connected between the seal section shaft and the pump shaft includes a body, a first receiving chamber within the body and a second receiving chamber within the body. The first receiving chamber receives the seal section shaft and the second receiving chamber receives the pump shaft. The coupling further includes a lock pin that through the body and through the seal section shaft and an axial shaft bolt captured within the body of the coupling and threadingly engaged to the pump shaft.

DETAILED DESCRIPTION OF THE PREFERRED EMBODIMENTS

Figure 1:
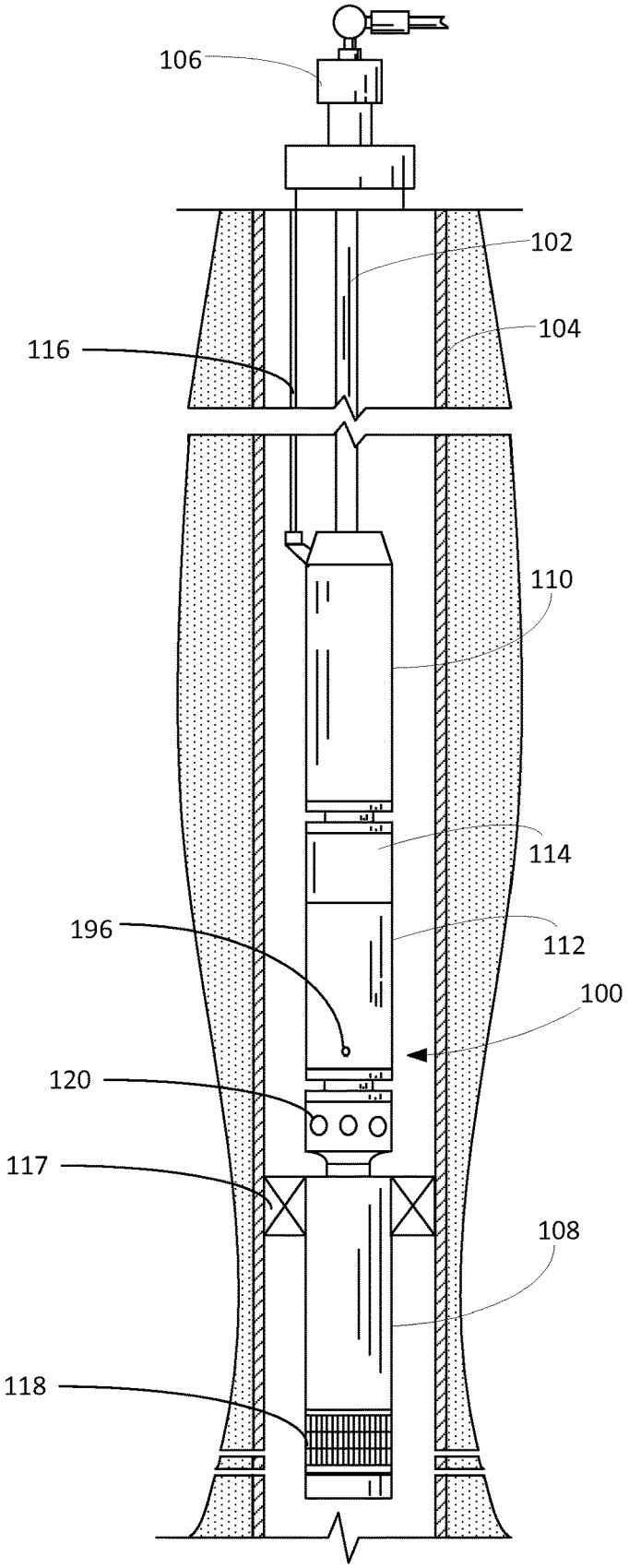
FIG. 1 depicts a submersible pumping system constructed in accordance with a preferred embodiment of the present invention.

In accordance with a first preferred embodiment of the present invention, FIG. 1 shows an elevational view of a pumping system 100 attached to production tubing 102. The pumping system 100 and production tubing 102 are disposed in a wellbore 104, which is drilled for the production of a fluid such as water or petroleum. As used herein, the term "petroleum" refers broadly to all mineral hydrocarbons, such as crude oil, gas and combinations of oil and gas.

The pumping system 100 preferably includes a pump 108, a motor 110, a seal section 112 and a thrust chamber 114. The production or coiled tubing 102 connects the pumping system 100 to a wellhead 106 located on the surface. Although the pumping system 100 is primarily designed to pump petroleum products, it will be understood that the present invention can also be used to move other fluids. It will also be understood that, although each of the components of the pumping system are primarily disclosed in a submersible application, some or all of these components can also be used in surface pumping operations.

The motor 110 receives power from a surface-based facility through power cable 116. Generally, the motor 110 is configured to drive the pump 108. In a particularly preferred embodiment, the pump 108 is a turbomachine that uses one or more impellers and diffusers to convert mechanical energy into pressure head. In alternate embodiments, the pump 108 is configured as a positive displacement pump. The pump 108 includes a pump intake 118 that allows fluids from the wellbore 104 to be drawn into the pump 108. The pump 108 also includes a pump discharge 120 that permits the expulsion of pressurized fluids from the pump 108. It will be understood that the pump 108 forces the wellbore fluids to the surface through the annulus of the wellbore 104 above a packer or annulus seal 117. Alternatively, the fluid can be produced through production or coiled tubing 102 by employing a second packer or annulus seal (not shown in FIG. 1) that reroutes the pumped fluid into the production or coiled tubing 102.

As illustrated in FIG. 1, the pumping system 100 is configured such that the pump 108 is located at the lower end of the equipment string, with the seal section 112 positioned between the motor 110 and the pump 108. The discharge 120 of the pump 108 is adjacent the seal section 112. The thrust chamber 114 is positioned between the motor 110 and the seal section 112. In this configuration, the operation of the pump 108 creates a downward thrust in a direction away from the thrust chamber 114.

Although only one of each component is shown, it will be understood that more can be connected when appropriate, that other arrangements of the components are desirable and that these additional configurations are encompassed within the scope of preferred embodiments. For example, in many applications, it is desirable to use tandem-motor combinations, shrouds, gas separators, multiple seal sections, multiple pumps, sensor modules and other downhole components.

It will be noted that although the pumping system 100 is depicted in a vertical deployment in FIG. 1, the pumping system 100 can also be used in non-vertical applications, including in horizontal and non-vertical wellbores 104. Accordingly, references to "upper" and "lower" within this disclosure are merely used to describe the relative positions of components within the pumping system 100 and should not be construed as an indication that the pumping system 100 must be deployed in a vertical orientation.

Figure 2:
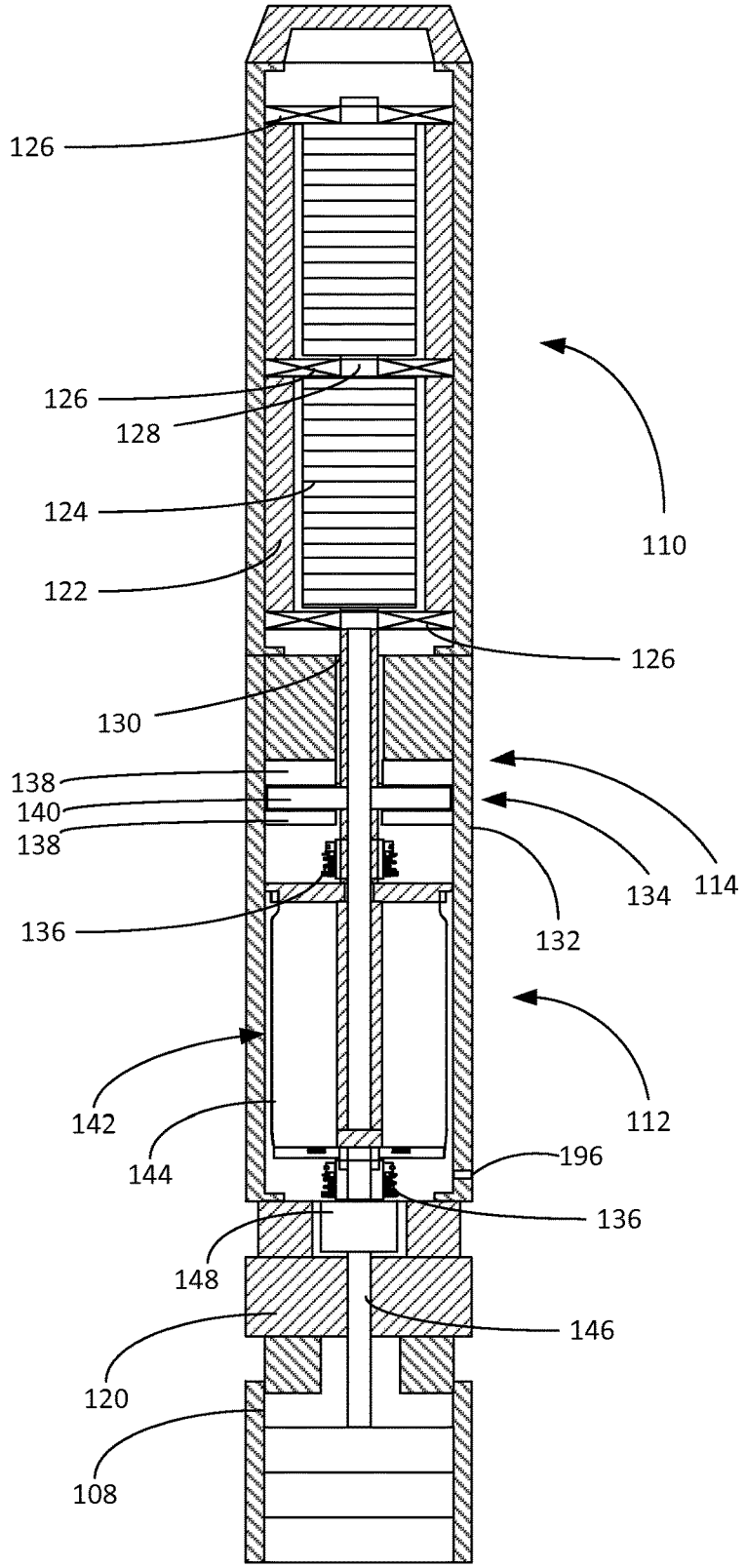
FIG. 2 provides a cross-sectional view of the motor, thrust chamber, seal section and pump of the pumping system of FIG. 1.

Turning to FIG. 2, shown therein is a cross-sectional view of the motor 110, thrust chamber 114, seal section 112 and pump 108. As depicted in the close-up view of the motor 110 in FIG. 2, the motor 110 preferably includes a stator assembly 122, rotor assembly 124, rotor bearings 126 and a motor shaft 128. The stator assembly 122 includes a series of stator coils (not separately designated) that correspond to the various phases of electricity supplied to the motor 110. The rotor assembly 124 is keyed to the motor shaft 128 and configured for rotation in close proximity to the stationary stator assembly 122. The size and configuration of the stator assembly 122 and rotor assembly 124 can be adjusted to accommodate application-specific performance requirements of the motor 110.

Sequentially energizing the various series of coils within the stator assembly 122 causes the rotor assembly 124 and motor shaft 128 to rotate in accordance with well-known electromotive principles. The rotor bearings 126 maintain the central position of the rotor assembly 124 within the stator assembly 122 and oppose radial forces generated by the motor 110 on the motor shaft 128. The motor shaft 128 is connected to a seal section shaft 130 that extends through the thrust chamber 114 and seal section 112. The seal section shaft 130 transfers torque from the motor 110 to the pump 108.

The thrust chamber 114 includes a thrust chamber housing 132, a thrust bearing assembly 134 and a plurality of mechanical seals 136. The thrust bearing assembly 134 includes a pair of stationary bearings 138 and a thrust runner 140 attached to the seal section shaft 130. The thrust runner 140 is captured between the stationary bearings 138, which limit the axial displacement of the thrust runner 140 and the seal section shaft 130.

The seal section 112 is attached to the lower end of the thrust chamber 114. To permit the expansion and contraction of the motor lubricants under elevated wellbore temperatures, the seal section 112 preferably includes a seal mechanism 142. In the preferred embodiment depicted in FIG. 2, the seal mechanism 142 is a bag seal assembly that includes a bladder 144. It will be appreciated that other seal mechanisms 142 may be incorporated into the seal section 112 as additional or alternative seal mechanism 142 to the bladder 144. Such additional seal mechanisms include bellows, pistons, labyrinths and combinations of these mechanisms.

The pump discharge 120 is connected to the lower end of the seal section 112. Torque from the motor 110 is carried from the seal section shaft 130 to the pump 108 through a pump shaft 146. A coupling 148 is used to connect the seal section shaft 130 to the pump shaft 146. Although the coupling 148 is depicted between the seal section 112 and the pump 108, it will be appreciated that the coupling 148 may be incorporated at other shaft connections within the pumping system 100. For example, it may be desirable to connect the motor shaft 128 to the seal section shaft 130 with the coupling 148.

Figure 3:
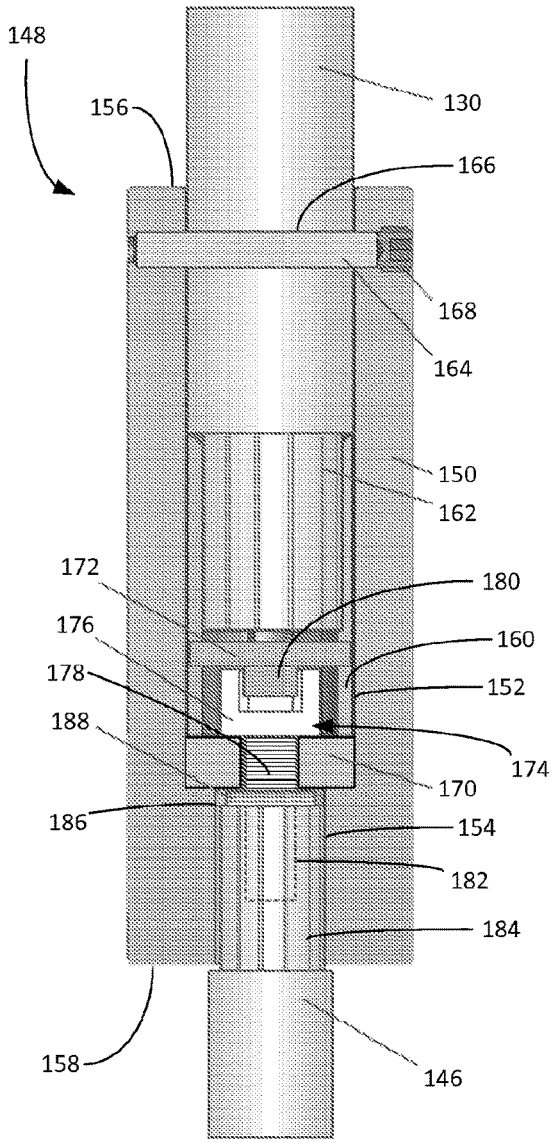
FIG. 3 provides a cross-sectional view of a shaft coupling constructed in accordance with a first preferred embodiment.
Figure 4:
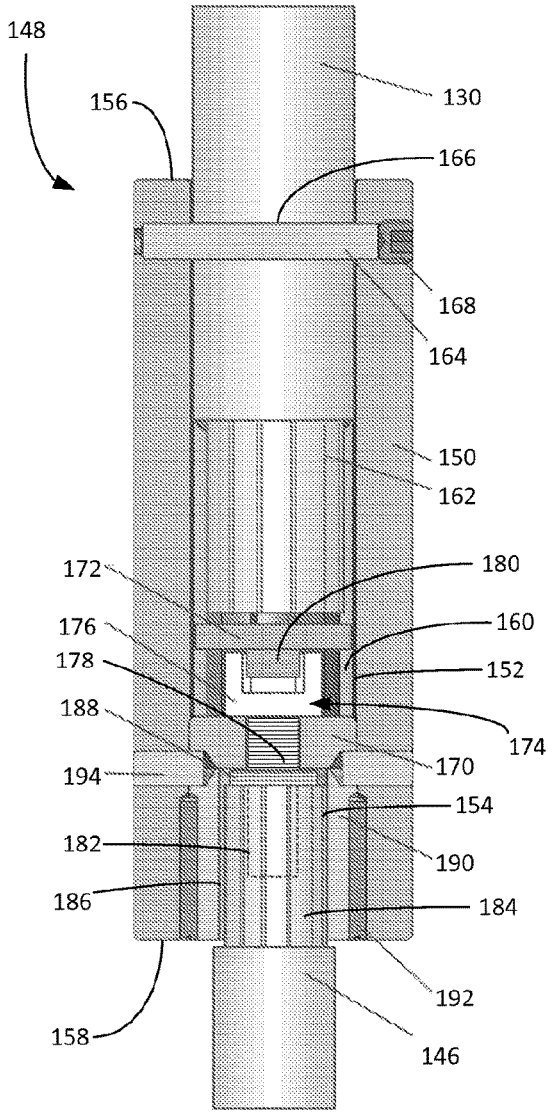
FIG. 4 provides a cross-sectional view of a shaft coupling constructed in accordance with a second preferred embodiment.

Turning to FIGS. 3 and 4, shown therein are partial cross-sectional views of the shaft coupling 148 constructed in accordance with preferred embodiments. The coupling 148 generally permits standard shafts (such as motor shaft 128, seal section shaft 130 and pump shaft 146) to be joined with a mechanism that allows for the precise axial positioning of the shafts while at the same time accommodating for a tensile loading along the shafts.

The coupling 148 includes a body 150, a first receiving chamber 152 and a second receiving chamber 154. The first receiving chamber 152 extends from a first end 156 of the body 150 and the second receiving chamber 154 extends from a second, opposite end 158 of the body 150. The first receiving chamber 152 and second receiving chamber 154 together create an internal passage through the center of the body 150.

The first receiving chamber 152 is sized and configured to receive a distal end of the seal section shaft 130. The first receiving chamber 152 includes coupling splines 160 that are configured to mate with seal section shaft splines 162 on the distal end of the seal section shaft 130. To prevent the seal section shaft 130 from axially moving within the coupling 148, the coupling 148 further includes a lock pin 164 that extends through the body 150 and through a lock pin aperture 166 in the seal section shaft 130. The lock pin 164 is held in place by a set screw 168.

The first receiving chamber 152 further includes a thrust plate 170 adjacent the second receiving chamber 154, an anti-rotation key 172 and axial shaft bolt 174 that extends into the second receiving chamber 154. As depicted in FIG. 3, the axial shaft bolt 174 includes a bolt head 176 that rests on the interior side of the thrust plate 170 and a bolt shaft 178 that extends through the thrust plate 170 into the second receiving chamber 154. The anti-rotation key 172 is keyed to the coupling splines 160 inside the first receiving chamber 152 and includes an extension 180 that mates with the bolt head 176. In a particularly preferred embodiment, the bolt head 176 includes a hexagonal recess that corresponds to a hexagonal-shaped extension 180. The engagement of the axial shaft bolt 174 with the anti-rotation key 172 prevents the axial shaft bolt 174 from rotating with respect to the body 150 of the coupling 148.

The second receiving chamber 154 is sized and configured to accept a proximal end of the pump shaft 146. The proximal end of the pump shaft 146 includes a threaded center bore 182 and external pump shaft splines 184. The external pump shaft splines 184 mate with corresponding splines 186 on the interior of the second receiving chamber 154 to cause the pump shaft 146 to rotate with the coupling 148.

The pump shaft 146 is prevented from axial displacement within the coupling 148 by the axial shaft bolt 174. The threaded center bore 182 is configured to accept the bolt shaft 178 in a threaded engagement. The extent of engagement between the bolt shaft 178 and threaded center bore 182 affects the axial position of the pump shaft 146 relative to the coupling 148. Because the overall length and position of the pump shaft 146 is important to maintain proper clearances of components connected to the pump shaft 146, the coupling 148 optionally includes one or more shims 188 between the pump shaft 146 and the thrust plate 170. The shims 188 preferably fit around the bolt shaft 178.

In an alternate preferred embodiment depicted in FIG. 4, the second receiving chamber 154 includes a spline insert 190 that can be locked into the body 150 with dowels 192. In this embodiment the thrust plate 170 is held in position within the body 150 adjacent the spline insert 190 by lateral pins 194 that extend radially inward through the body 150. The spline insert 190 can be made available in different sizes and configurations to adapt the coupling 148 to fit a variety of pump shafts 146.

In a presently preferred embodiment, a method of connecting the pump shaft 146 to the seal section shaft 130 with the coupling 148 includes the following steps. First, the coupling is prepared by inserting the thrust plate 170 into the first receiving chamber 152. It will be appreciated that the thrust plate 170 can be an integral part of the body 150 or a separate piece that is removable from the first receiving chamber 152. Next the coupling 148 and the pump shaft 146 are connected. The axial shaft bolt 174 is then inserted into the first receiving chamber 152 and threaded into the center bore 182 of the pump shaft 146. The extent of engagement between the pump shaft 146 and the coupling 148 can be precisely controlled by adding or removing shims 188 between the pump shaft 146 and the thrust plate 170. Once the desired positioning between the pump shaft 146 and coupling 148 has been obtained, the axial shaft bolt 174 is tightened to specification and locked into position with the anti-rotation key 172. The pump shaft 146 and coupling 148 are then axially and rotationally locked together.

Next, the seal section shaft 130 is connected to the coupling 148. In a particularly preferred embodiment, the coupling 148 and pump shaft 146 are approximated to the seal section shaft by moving the pump 108 into position below the seal section 112. The seal section shaft 130 is inserted into the first receiving chamber 152 to the point at which the lock pin 164 can be inserted into the lock pin bore 166. The lock pin 164 can be inserted into the lock pin bore 166 from outside the seal section 112 through a lock pin port 196 (shown in FIGS. 1 and 2). Once the lock pin 164 has been inserted into the seal section shaft 130 the set screw 168 is inserted into the body 150 of the coupling 148 to prevent the unintended removal of the lock pin 164. Once the lock pin 164 has been placed into the lock pin bore 166, the seal section shaft 130 is axially and rotationally locked into position with the coupling 148.

In this way, the coupling 148 provides an improved connection mechanism that can operate under tension and that permits the selective engagement of a first shaft with the coupling 148 while allowing for the connection of a second shaft with the coupling 148 with an externally engaged pinned connection. It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A shaft coupling for connecting a distal end of a first shaft with a proximal end of a second shaft, wherein the second shaft includes an axially-directed center bore extending from the proximal end, the coupling comprising:

a body, a first receiving chamber within the body, wherein the first receiving chamber receives the distal end of the first shaft and wherein the first receiving chamber includes a series of splines that engage a mating series of splines on an exterior of the distal end of the first shaft;

a second receiving chamber within the body, wherein the second receiving chamber receives the proximal end of the second shaft;

a thrust plate positioned within the body between the first receiving chamber and the second receiving chamber;

a lock pin; wherein the lock pin extends through the body and through the distal end of the first shaft;

an axial shaft bolt captured within the body of the coupling, wherein the axial shaft bolt is threadingly engaged to the center bore of the second shaft and wherein the axial shaft bolt comprises a bolt head inside the first receiving chamber and a bolt shaft extending through the thrust plate into the second receiving chamber in threaded engagement to the center bore of the second shaft; and an anti-rotation key connected to the body and to the bolt head, wherein the anti-rotation key engages the splines of the first receiving chamber.

2. The coupling of claim 1, wherein the first shaft is selected from the group consisting of motor shafts, seal section shafts, thrust chamber shafts and pump shafts.

3. The coupling of claim 2, wherein the second shaft is selected from the group consisting of motor shafts, seal section shafts, thrust chamber shafts and pump shafts.

4. The coupling of claim 1, wherein the second receiving chamber includes a series of splines that engage a mating series of splines on an exterior of the proximal end of the second shaft.

5. The coupling of claim 1, wherein the second receiving chamber includes a spline insert that includes a series of splines that engage a mating series of splines on an exterior of the proximal end of the second shaft.

6. The coupling of claim 1, further comprising one or more shims around the bolt shaft between the thrust plate and the proximal end of the second shaft.

7. An electric submersible pumping system comprising:

a motor, wherein the motor includes a motor shaft that transmits torque from the motor;

a pump, wherein the pump includes a pump shaft and wherein the pump is configured to discharge fluid toward the motor;

a seal section connected between the pump and the motor, wherein the seal section includes a seal section shaft; and a shaft coupling connected between the seal section shaft and the pump shaft, wherein the coupling comprises:

a body;

a first receiving chamber within the body, wherein the first receiving chamber receives the seal section shaft and wherein the first receiving chamber includes a series of splines that engage a mating series of splines on an exterior of the seal section shaft;

a second receiving chamber within the body, wherein the second receiving chamber receives the pump shaft;

a thrust plate positioned within the body between the first receiving chamber and the second receiving chamber;

a lock pin; wherein the lock pin extends through the body and through the seal section shaft;

an axial shaft bolt captured within the body of the coupling, wherein the axial shaft bolt is threadingly engaged to the pump shaft and wherein the axial shaft bolt comprises a bolt head inside the first receiving chamber and a bolt shaft extending through the thrust plate into the second receiving chamber in threaded engagement to the pump shaft; and an anti-rotation key connected to the body and to the bolt head, wherein the anti-rotation key engages the splines of the first receiving chamber.

8. The electric submersible pumping system of claim 7, wherein the second receiving chamber includes a series of splines that engage a mating series of splines on an exterior of the pump shaft.

9. The electric submersible pumping system of claim 7, wherein the seal section includes a lock pin port that provides access to the lock pin.

10. A shaft coupling for connecting a distal end of a first shaft with a proximal end of a second shaft, the coupling comprising:

a body;

a first receiving chamber within the body, wherein the first receiving chamber receives the distal end of the first shaft and wherein the first receiving chamber includes a series of splines;

a pinned connection between the body and the distal end of the first shaft;

a second receiving chamber within the body, wherein the second receiving chamber receives the proximal end of the second shaft;

an axially adjustable connection between the second receiving chamber and the proximal end of the second shaft, wherein the axially adjustable connection comprises:

a thrust plate positioned within the body between the first receiving chamber and the second receiving chamber;

an axial shaft bolt captured within the body of the coupling by the thrust plate, wherein the axial shaft bolt extends through the thrust plate and is threadingly engaged to a center bore of the second shaft; and one or more shims positioned between the proximal end of the second shaft and the thrust plate, wherein the one or more shims control the extent of engagement between the axial shaft bolt and the center bore of the second shaft; and an anti-rotation key connected to the body and to a bolt head of the axial shaft bolt, wherein the anti-rotation key engages the series of splines in the first receiving chamber.

* * * * *